United States Patent [19]

Bauer

[11] 4,285,360

[45] Aug. 25, 1981

[54] APPARATUS FOR WITHDRAWING THE OIL FROM AN INTERNAL COMBUSTION ENGINE

[75] Inventor: Johann G. H. Bauer, Hasbergen, Fed. Rep. of Germany

[73] Assignee: Robert K. Bauer, Mississauga, Canada

[21] Appl. No.: 97,155

[22] Filed: Nov. 26, 1979

[30] Foreign Application Priority Data

| | | | |
|---|---|---|---|
| Nov. 27, 1978 | [DE] | Fed. Rep. of Germany | 7835250[U] |
| Sep. 22, 1979 | [DE] | Fed. Rep. of Germany | 7926919[U] |
| Sep. 26, 1979 | [DE] | Fed. Rep. of Germany | 7927321[U] |

[51] Int. Cl.[3] ..... F16N 33/00; F01M 11/04

[52] U.S. Cl. ..... 137/205; 137/202; 184/1.5

[58] Field of Search ..... 137/205, 355.16, 355.17, 137/377, 202; 184/1.5; 141/59, 61

[56] References Cited

U.S. PATENT DOCUMENTS

| | | | |
|---|---|---|---|
| 2,603,312 | 7/1952 | Tabet | 184/115 |
| 2,682,886 | 7/1954 | Paxton | 137/205 |
| 3,095,062 | 6/1963 | Neely | 184/8.5 |
| 3,430,730 | 3/1969 | Kitajima | 184/1.5 |

*Primary Examiner*—Alan Cohan

*Attorney, Agent, or Firm*—Schwartz, Jeffery, Schwaab, Mack, Blumenthal & Koch

[57] ABSTRACT

Apparatus for withdrawing motor oil from the crankcase of an internal combustion engine comprising a rigid, fluid-tight receptacle, a vacuum line connecting the receptacle to a source of vacuum, a check valve in the vacuum line for preventing backflow of gas therethrough, a portable inlet probe for insertion through the oil dipstick tube into the crankcase of the internal combustion engine, a suction line connecting the inlet probe to said receptacle, a control valve on said suction line for selectively opening and closing the suction line, and sheath forming means projecting into the interior of the receptacle for receiving and storing the inlet probe when not in use.

20 Claims, 2 Drawing Figures

APPARATUS FOR WITHDRAWING THE OIL FROM AN INTERNAL COMBUSTION ENGINE

This invention relates to apparatus for withdrawing a liquid from a container. More particularly, this application relates to apparatus useful for withdrawing lubricating fluids from relatively inaccessible containers. Specifically, the applicaton relates to apparatus for withdrawing the motor oil from an internal combustion engine or other similar liquid withdrawal tasks.

BACKGROUND OF THE INVENTION

It is well known that lubricating oils used in internal combustion engines lose their effectiveness over a period of time due to accumulation of dirt or other foreign matter therein and due to breakdown of the oil or the additives incorporated therein. In order to prevent excessive engine wear, it is therefore necessary to change the oil at periodic intervals. Typically, the old oil is removed from the engine by withdrawing a plug from the oil pan at the bottom of the engine and allowing the oil to run out into some kind of collector. The conventional procedure, however, is disadvantageous in that it is necessary either to have a lift to raise the car above the ground, or to crawl under the car. Not infrequently, the person changing the oil gets all dirty. Also, oil is often spilled, which leaves unsightly stains and pollutes the environment.

For maximum efficiency, it is most desirable that the engine oil be changed while hot. In actual practice, however, the vehicle is usually allowed to sit before the oil is drained therefrom in the conventional fashion. This arises both from the necessity of waiting one's turn to receive service at a service station and also from a desire of a person changing the oil not to be burned with hot oil as he removes the plug from the drain outlet of the oil pan.

Various types of alternative systems have been proposed to avoid draining the oil in the conventional fashion. One system now being marketed involves a pump designed to be driven by a conventional electric hand drill. The suction line of the pump is inserted down the oil dipstick tube and the delivery line is inserted in a suitable container. This system is not satisfactory, however, because it lacks sufficient power to remove the heavy sludge which accumulates at the bottom of the oil pan.

Another system is disclosed in Boyd, et al., U.S. Pat. No. 3,773,091. In this system, a vacuum tank is evacuated by connecting it to the intake manifold of an internal combustion engine. When the pressure in the tank has been reduced to the desired level, the vacuum line is closed off, and a suction line communicating between the drain opening of the oil pan and the tank is opened. Ambient pressue then forces the oil from the drain pan through the line into the evacuated tank. This system is not entirely practical because it requires a permanent connection to the drain opening of the engine oil pan.

A similar system is disclosed in Winkelvoss, U.S. Pat. No. 4,119,117 in which a vacuum tank is connected to the crankcase of an internal combustion engine through a specially designed control valve which shuts off the suction line after all of the oil has been withdrawn. The valve arragement of Winkelvoss is complex and expensive.

It is also known to secure the inlet probes of suction oil change devices to the outside of the oil-receiving containers. Such arrangements, however, are disadvantageous in that the probes may be bumped and damaged and also that persons around the apparatus may inadvertently brush against the oily probes and soil their clothing. Mounting the probes on the exterior of the receiving containers also renders the assembly more cumbersome and difficult to handle.

SUMMARY OF THE INVENTION

Accordingly, it is an object of the present invention to provide apparatus for withdrawing a liquid from a container.

A further object of the invention is to provide apparatus for efficiently withdrawing dirty engine oil from the crankcase of an internal combustion engine.

Yet another object of the present invention is to provide apparatus which efficiently removes all of the oil, including the heavy sludge at the bottom of the crankcase.

A further object of the present invention is to provide apparatus which can be conveniently operated without the necessity of lifting or crawling underneath the car.

Still another object of the present invention is to provide apparatus for withdrawing a liquid from a container which prevents spillage.

A further object of the present invention is to provide apparatus for withdrawing a liquid from a container which can be permanently installed in a motor vehicle.

It is also an object of the present invention to provide an apparatus for withdrawing a liquid from a container which can be used by a home handyman.

Another object of the present invention is to provide apparatus for withdrawing liquid from a container which could be used in a professional service station.

A further object of the present invention is to provide apparatus for withdrawing used engine oil from an internal combustion engine while the oil is hot.

Another object of the present invention is to provide apparatus for withdrawing a liquid from a container which can be manufactured inexpensively.

Yet another object of the present invention is to provide apparatus for withdrawing a liquid from a container which provides for convenient storage of the inlet probe when not in use in an out-of-the-way location where persons cannot inadvertently bump into it and soil their clothing.

These and other objects of the invention are achieved by providing apparatus for withdrawing a liquid from a container comprising a rigid fluidtight receptacle, vacuum line means for connecting said receptacle to a source of vacuum, check valve means associated with said vacuum line means for preventing backflow of gas therethrough, portable inlet probe means for insertion into said container to take up said liquid, suction line means connecting said inlet probe means to said receptacle, control valve means associated with said suction line means for selectively opening and closing said suction line means, and sheath forming means projecting into the interior of said receptacle without destroying the fluid tightness thereof for receiving and storing said inlet probe means when not in use.

The apparatus is useful to remove used motor oil from the crankcase of an internal combustion engine. In a preferred embodiment, the inlet probe means is an elongated tubular probe sized to pass through the dipstick tube of an internal combustion engine. The intake manifold of an internal combustion engine is utilized as the vacuum source. A float-operated overflow control valve is provided to prevent overfilling of the receptacle and passage of used oil into the vacuum line. One-hand, quickrelease fittings are utilized to connect the vacuum line and the suction line to the receptacle. A small quantity of liquid is retained at all times in the receptacle in order to protect the receptacle against thermal shock. Preferably, the sheath forming means comprises a pair of nipples projecting through the top wall of the receptacle and a length of flexible pressure hose, the ends of which are secured to the inteior ends of said nipples in order to form a U-shaped passageway, each arm of which serves as a sheath for a separate inlet probe.

BRIEF DESCRIPTION OF THE DRAWINGS

The invention will be explained in further detail with reference to the accompanying drawings wherein.

DETAILED DESCRIPTION OF PREFERRED EMBODIMENTS

Figure 1:
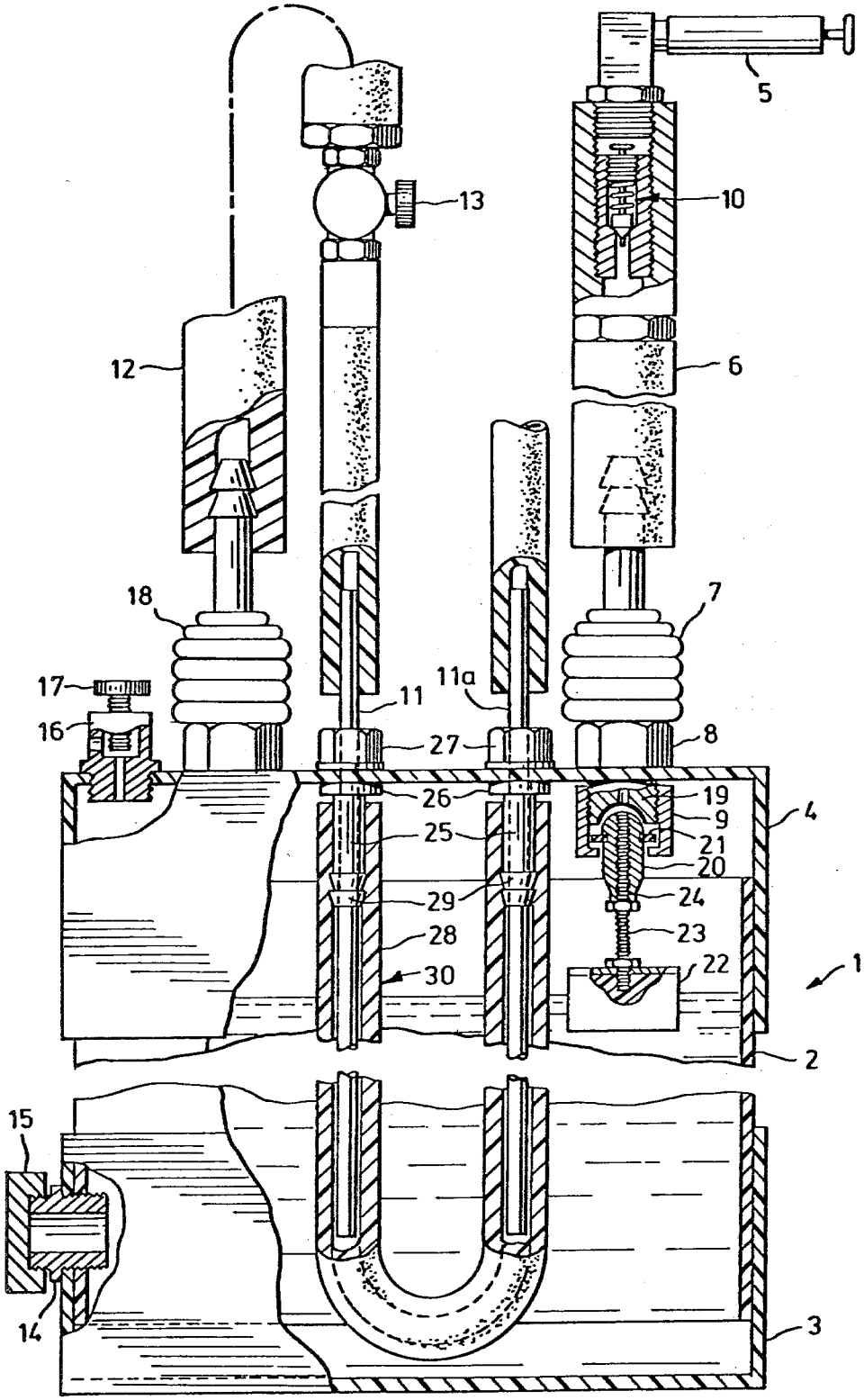
FIG. 1 is a schematic elevation, partially in section, of a preferred apparatus according to the present invention.

FIG. 1 depicts an apparatus comprising a container 1 made from a tubular cylindrical body portion 2, a closed end bottom cap 3 and a closed end top cap 4. This apparatus is specifically adapted for use in small repair shops and service stations or in home garages. Bottom 3 and top 4 fit over the ends of tubular body 2 and are secured thereto with a suitable adhesive in order that receptacle 1 will be fluid tight. Receptacle 1 must be sufficiently rigid to withstand a substantial pressure differential between the inside and the outside thereof. The receptacle may be made of a number of suitable materials. Preferably, the receptacle is made of a high-strength thermoplastic polymeric material, such as rigid polyvinyl chloride. Rigid polyvinyl chloride pipe and end caps can be readily fused or glued together in a cold state. The polyvinyl chloride can also be easily worked, i.e., drilling of holes and tapping of threads can be accomplished with comparatively simple tools in a minimum of time. Other materials, such as acrylic or glass, may also be utilized.

Receptacle 1 is connected to a vacuum source, such as pump 5, by means of vacuum hose 6. Commercially available, nylon-reinforced pneumatic hoses may be used as the vacuum hose. The connection between hose 6 and receptacle 1 is effected via a standard one-hand, quick-release fitting 7 so that the hose may be readily attached to or disassembled from the receptacle with a minimum of effort. The internal valve in fitting 7 closes to maintain the fluid-tight nature of receptacle 1 when hose 6 is detached. Standard external and internal mounting nuts, 8 and 9 respectively, are used to secure the quick-release fitting to the receptacle.

Associated with vacuum hose 6 is an internal check valve 10 which acts to prevent backflow of gases through line 10. It is thereby possible to disconnect the vacuum source 5 from the line without losing the vacuum built up in receptacle 1. A regular bicycle tire valve, properly fitted to the inside of hose 6, may be used as the check valve. If desired, the receptacle may be provided with an optical vacuum gauge (not shown).

Receptacle 1 is also connected to an inlet probe 11 through a suction hose 12. As in the case of the vacuum hose, suction hose 12 is connected to receptacle 1 via a standard one-hand, quick-release fitting 18. A manually-operated valve, such as ball cock, 13 is interposed in suction line 12 to facilitate selective opening and closing of the line.

Receptacle 1 is also provided with an outlet spigot 14 which extends through the wall of the receptacle near the bottom thereof. Spigot 14 is closed with a fluid-tight cap 15. Receptacle 1 is further provided with an air inlet valve 16 mounted in the top wall cap 4 which is opened or closed by respectively loosening or tightening thumbscrew 17.

It will be appreciated that, if receptacle 1 is overfilled and waste oil is drawn up into the vacuum source, serious damage to the vacuum source may result. For this reason, the nipple end 19 of fitting 7 which projects through the top wall of cap 4 into the interior of receptacle 1 is provided with overflow control valve means to prevent used oil from overfilling the receptacle and being drawn up through vacuum line 6 to the vacuum source. In the illustrated embodiment, the overflow control valve means comprises a plug 20 which is secured to the threads of nipple 19 by mounting nut 9. Plug 20 is provided with a seal 21 which tightly closes off the inlet to vacuum line 6 when plug 20 is pushed up into engagement with nipple 19. In order to facilitate proper positioning of plug 20, nipple 19 has been provided with a concave end surface which mates with a correspondingly convex surface on the end of plug 20. Plug 20 is connected to a float 22 by means of a vertically oriented shaft or rod 23. In the illustrated embodiment, plug 20 is generally tubular in form, with rod 20 received in the tubular cavity. The lower end of plug 20 is provided with a resilient seal 24 which fits tightly against rod 23 and prevents passage of fluid up alongside rod 23 through the tubular channel of plug 20. If desired, rod 23 can be threaded, and the height of float 22 can be adjusted by screwing rod 23 inwardly or outwardly, as desired. Mounting nut 9 fits somewhat loosely around plug 20 so that the plug has sufficient play to open and close the mouth of nipple 19 as float 22 moves up and down. The described design of overflow control valve enables the container to have a useful volume which is only slightly smaller than its nominal volume, thereby providing maximum capacity in an apparatus of minimum size.

The apparatus of the invention is also provided with novel sheath means for the inlet probe. The sheath means projects into the inteior of receptacle 1 and forms a cavity or holster for the probe. The sheath is, of course, fluid tight so that the fluit-tight nature of receptacle 1 is not destroyed.

In the illustrated embodiment, the sheath is formed by a pair of nipples 25 which project through the top wall of cover 4 into the interior of receptacle 1. The inside portion of each nipple is provided with an enlarged portion 26 which is seated firmly against the top wall of cover 4. A pair of mounting nuts 27 are screwed onto the threaded outer ends of nipples 25 in order to firmly secure the nipples in place. If necessary, a resilient seal (not shown) can be interposed between enlarged portion 26 and the top wall of the receptacle. A flexible pressure hose 28 is positioned inside receptacle 1 with its two ends fitting tightly over the projecting interior portions of nipples 25. The length of hose 28 is selected so as to provide a sheath 30 which is long enough to receive probe 11. Each nipple is provided with a series of ridges 29 which assist in holding the hose tightly on the nipples so that it will not be blown off by the exterior pressure when the interior of the receptacle is evacuated. In the preferred embodiment, the two nipples 25 are disposed adjacent each other on the top wall of receptacle cap 4. The hose thus forms a U-shaped channel or passageway beginning at one nipple and ending at the other. Each arm of the passageway may serve as a sheath or holster 30 for inlet probe 11 when the probe is not in use. If desired, the mouth of the sheath can be provided with a quick-release connector to hold the probe in position in the sheath. The probe is thus maintained in a convenient out-of-the-way location. The protected central location also prevents damage to the probe which might occur from an inadvertent bump if it were mounted on the exterior of the receptacle. Moreover, there is no possibility of persons inadvertently soiling their clothing by brushing against the probe.

It may be desirable to have a plurality of different shapes and sizes of probes to fit different engines. For example, an 8 mm diameter probe could be used for larger engines, a 6 mm diameter probe could be utilized for smaller engines, and a flexible probe could be utilized for special applications. The U shape of the sheath channel in the illustrated embodiment is thus advantageous because it provides sheaths for two probes. In the drawing, a second probe **11*a* is illustrated in the right-hand channel formed by hose 28. Of course, additional nipples and hoses could be utilized to provide further sheaths for probes in excess of two. Hose 28 may be similar in construction to hoses 6 and 12, though it will ordinarily have a larger diameter in order to facilitate free insertion and removal of probe 11** into and out of the sheath.

The operation of the illustrated device is as follows. Spigot 14 and air inlet 16 are closed along with suction line valve 13. Vacuum source 5 is then energized to withdraw air from receptacle 1 through fitting 7 and vacuum line 6. When the desired underpressure has been achieved, inlet probe 11 is withdrawn from sheath 30. The oil dipstick is pulled out and probe 11 is inserted through the dipstick tube until the end of the probe contacts the oil pan at the bottom of the crankcase. Valve 13 is then opened, and the ambient pressure forces the oil from the crankcase through probe 11, suction line 12, and fitting 18 into receptacle 1. The flow of oil proceeds until all of the oil has been withdrawn from the engine crankcase. If the initial vacuum in the receptacle is not sufficient to draw out all of the oil, the vacuum pump 5 may be operated to augment the initial vacuum until all of the oil has been withdrawn.

If the oil in receptacle 1 rises to the level of float 22, the upward force generated by the buoyancy of the float will be transmitted to plug 20 via rod 23. The convex tip of the plug will thereby be forced against the concave end of nipple 19 and seal 21 will be brought into engagement with the end of the nipple, thereby blocking off the passageway through the nipple and preventing further vacuum from being drawn in recepetacle 1. The flow of oil will continue briefly after the vacuum is cut off until the underpressure in the receptacle is insufficient to draw further oil into the receptacle. The additional oil will exert a further buoyant force on the float, thereby urging plug 20 more tightly than ever against nipple 19 and positively preventing any of the oil from passing through fitting 7 and vacuum line 6 to the vacuum source.

If vacuum source 5 is disconnected from vacuum line 6, check valve 10 acts to prevent the vacuum in receptacle 1 from being lost. The vacuum line may thus be switched from a primary vacuum source, such as the intake manifold of an internal combustion engine, to an auxiliary vacuum source, such as a hand pump.

After all of the oil has been withdrawn from the engine, air is permitted to pass through inlet probe 11, suction line 12 and fitting 18 until the pressure inside the receptacle 1 is equalized. The probe is then withdrawn from the dipstick tube of the engine and reinserted in sheath 30.

When receptacle 1 is full of oil, it may be emptied by removing cap 15 from spigot 14 and unscrewing thumbscrew 17 to permit air to enter through air valve 16. For convenience in handling the receptacle, vacuum line 6 and suction line 12 may be readily disconnected by means of the one-hand, quick-release fittings 7 and 18, respectively. As the connections are broken, valves inside the fittings automatically close to prevent spillage of the oil therethrough.

As the oil empties from the receptacle, the byoyant forces acting on float 22 cease and plug 20 disengages from nipple 19. Of course, to facilitate handling of the receptacle, handles may be provided as desired on the top or sides of the receptacle.

It will be noted that spigot 14 is disposed above the bottom of receptacle 1 defined by the bottom end cap 3. Consequently, a small amount of oil will always remain in the container. If hot oil is withdrawn from an engine into the receptacle, the reservoir of oil in the bottom of the receptacle serves to dissipate the initial heat of the incoming oil and thereby protects the receptacle against thermal shock.

Figure 2:
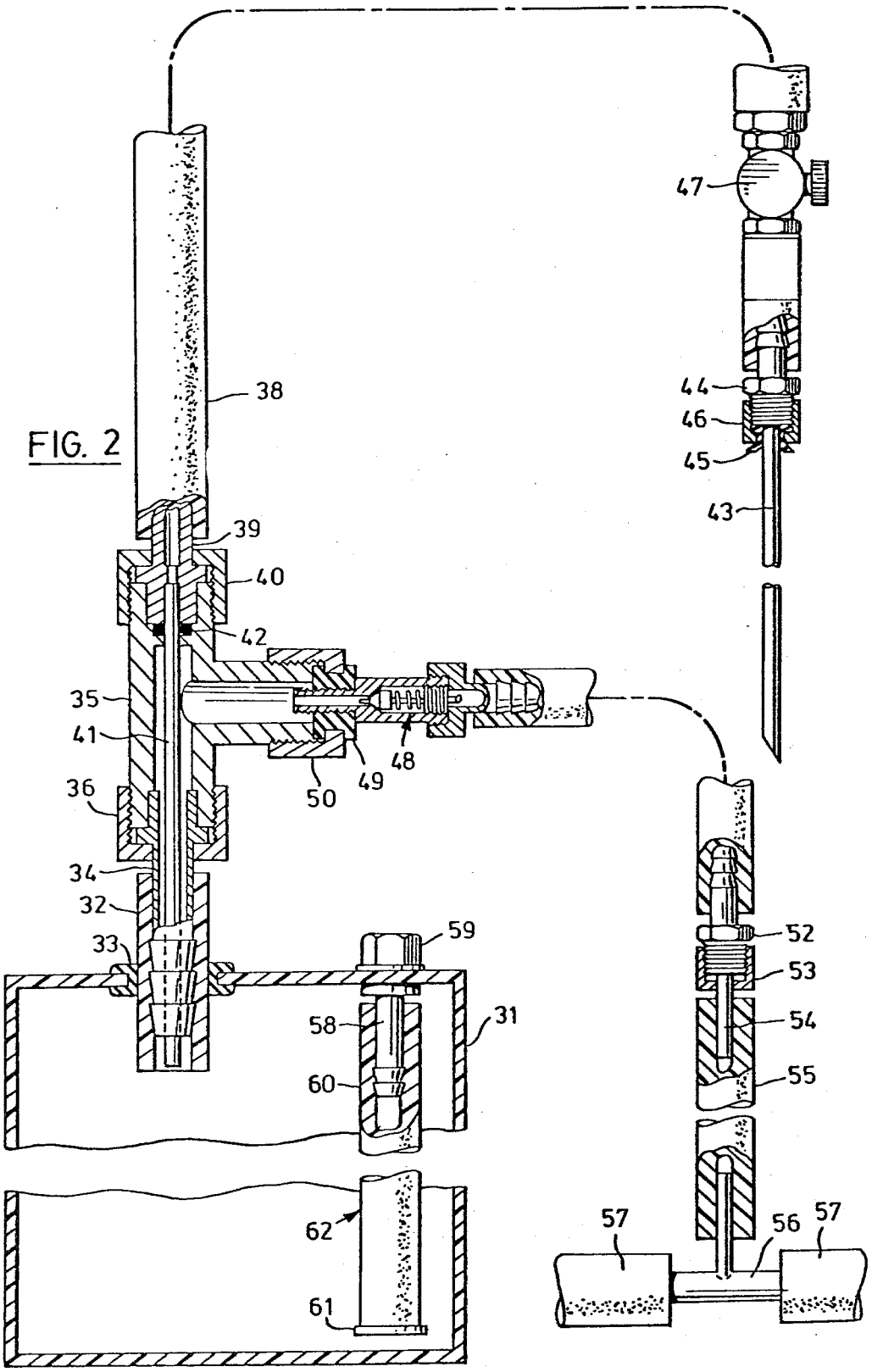
FIG. 2 is a schematic elevation of an alternative apparatus for withdrawing a liquid from a container.

FIG. 2 shows an alternate embodiment of the apparatus of the invention in which receptacle 31 is provided with a single inlet and outlet port through which a tube 32 is inserted. This apparatus is particularly designed to be built into an automotive vehicle. If necessary, an annular seal 33 may be provided around tube 32 to assure that receptacle 31 remains fluid tight. One end of an adapter 34 is inserted into tube 32. A series of ridges 37 may be provided on the end of adapter 34 which is inserted into tube 32 in order to firmly secure the adapter in the tube. The other end of the adapter is secured in one end of the straight channel of a Tee-fitting 35 by means of a mounting nut 36.

The upper end of the straight side of Tee-fitting 35 is connected to a suction line 38 by means of a second adapter 39 and a second mounting nut 40. An oil flow tube 41 extends from adapter 39 down through Tee-fitting 35 and adapter 34 into receptacle 31. The exterior of tube 41 is sealed tightly to adapter 39 by means of a resilient seal 42. In contrast thereto, the diameter of the inner passageway of adapter 34 is larger than the diameter of the exterior of tube 41 so that an annular channel leading to the interior of Tee-fitting 35 is formed between the tube and the adapter.

Suction line 38 is connected in an inlet probe 43 by means of an adapter 44, a seal 45 and a mounting nut 46. A manually operable ball cock valve 47 is interposed in suction line 38 for selectively opening and closing the suction line. The side leg of Tee-fitting 35 is connected to a check valve 48 by means of a resilient seal 49 and a mounting nut 50. A conventional bicycle tire valve may be utilized as the check valve. The other end of check valve 48 is seated in a vacuum line 51 which in turn is connected by means of adapter 52, mounting nut 53, tube 54 and hose section 55 to a Tee 56 interposed in the vacuum line 57 of an internal combustion engine.

Receptacle 31 is also provided with a nipple 58 which extends through the top wall of the receptacle and is secured thereto by mounting nut 59. A tubular body 60 is secured to the protruding interior of nipple 58 and a cap 61 is provided to close off the lower end of tube 60. Tube 60 thus defines a sheath or holster 62 for receiving inlet probe 43 when the probe is not in use.

The operation of the device is as follows. Valve 47 is closed and the engine with which vacuum line 57 is associated is started. Air is thereby withdrawn from receptacle 31 through the annular passageway between tube 41 and adapter 34 to the interior of Tee-fitting 35. The air is then drawn through check valve 48, vacuum line 51 and the intervening connecting parts until it passes away through vacuum line 57. After the engine has been run for a brief period, which may be as short as a minute or less, it is stopped. Check valve 48 prevents the vacuum is receptacle 31 from being lost when the engine is stopped. The dipstick is then removed and inlet probe 43 is inserted through the dipstick tube until it touches the bottom of the oil pan. Valve 47 is then opened and the ambient pressure forces the oil from the crankcase of the engine through probe 43, suction line 38 and tube 41 into receptacle 31. When all of the oil has been drawn out of the engine, inlet probe 43 is withdrawn from the dipstick tube and placed in sheath 62 for storage. Fresh oil is added to the engine and the dipstick is reinserted in the dipstick tube.

When receptacle 31 is full, the lower end of adapter 34 may be pulled out of tube 32 and the receptacle may be removed from the vehicle. The oil may be poured out of the receptacle using tube 32 as a spout. The extension of tube 32 into the interior of receptacle 31 prevents all of the oil from being poured out, so that a small amount of oil will always remain in the container to protect the container against thermal shock when hot oil is drawn thereinto.

It can be seen that there has been described apparatus which is highly effective, inexpensive to construct, simple and convenient to use, lightweight and durable.

The foregoing embodiments have been described only as examples of the invention. Since modifications of the disclosed embodiments may occur to persons skilled in the art, the scope of the invention is to be limited solely by the scope of the appended claims.

What is claimed is:

1. Apparatus for withdrawing a liquid from a container comprising:

a rigid, fluid-tight receptacle;

vacuum line means for connecting said receptacle to a source of vacuum;

check valve means associated with said vacuum line for preventing backflow of gas therethough;

portable inlet probe means for insertion into said container to take up said liquid;

suction line means connecting said inlet probe means to said receptacle;

control valve means associated with said suction line means for selectively opening and closing said suction line means; and sheath forming means projecting into the interior of said receptacle without destroying the fluid-tightness thereof for receiving and storing said inlet probe means when not in use.

2. Apparatus according to claim 1, wherein said liquid is motor oil and said container is the oil pan of an internal combustion engine.

3. Apparatus according to claim 1, wherein said inlet probe means is an elongated, tubular probe sized to pass through the dipstick tube of an internal combustion engine.

4. Apparatus according to claim 1, wherein said vacuum source is the intake manifold of an internal combustion engine.

5. Apparatus according to claim 1, wherein said control valve means is a manually operated valve located at the juncture of said suction line means and said inlet probe means.

6. Apparatus according to claim 1, wherein said check valve means is a conventional bicycle tire valve.

7. Apparatus according to claim 1 further comprising overflow control valve means for preventing liquid from entering said vacuum line means.

8. Apparatus according to claim 7, wherein said overflow control valve means is a float-operated valve for closing the outlet of said receptacle leading to said vacuum line means when the liquid in said chamber reaches a predetermined level.

9. Apparatus according to claim 1, wherein said vacuum line means and said suction line means are connected to said receptacle via one-hand, quickrelease connectors, each of said connectors having an internal valve for sealing said chamber when the associated line is disconnected.

10. Apparatus according to claim 1 further comprising means for discharging said liquid from said receiving chamber.

11. Apparatus according to claim 10, wherein said outlet means comprises a capped spigot near the bottom of said receptacle and a vent valve at the top of the receptacle.

12. Apparatus according to claim 11 further comprising means for retaining a small quantity of liquid in said receptacle to protect the receptacle against thermal shock.

13. Apparatus according to claim 1 further comprising auxiliary vacuum pump means connectable to said vacuum line means to provide an alternate vacuum source.

14. Apparatus according to claim 1, wherein said receptacle is made of rigid polyvinyl chloride.

15. Apparatus according to claim 1, wherein said sheath forming means comprises a passageway extending through said receptacle.

16. Apparatus according to claim 15, wherein said passageway comprises a pair of nipples projecting through the wall of said receptacle and a length of flexible pressure hose joining said nipples.

17. Apparatus according to clam 16, wherein a plurality of sheaths are provided.

18. Apparatus according to claim 17, wherein said nipples are disposed adjacent each other on the top wall of said chamber and said hose forms a U-shaped passageway, each arm of said U-shaped passageway providing a sheath for a separate inlet probe.

19. Apparatus according to claim 8, wherein said vacuum line is connected to said receptacle via a nipple extending through the top of said receptacle and said float-operated valve means comprises a movable plug secured to the inner end of said nipple by a mounting nut, a resilient seal on said movable plug for blocking off said nipple when said plug moves into engagement therewith, a float for sensing the level of liquid in the receptacle, and a vertical rod connecting said float to said plug.

20. Apparatus according to claim 19, wherein the inner end of the nipple is provided with a concave surface which mates with a matching convex surface on said plug when the plug is lifted by the float into engagement with the nipple.

* * * * *